US009642443B2

(12) United States Patent
Amago

(10) Patent No.: US 9,642,443 B2
(45) Date of Patent: May 9, 2017

(54) BACKPACK WITH CLOSURE MECHANISMS

(71) Applicant: NIKE, Inc., Beaverton, OR (US)

(72) Inventor: Justin Amago, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/669,647

(22) Filed: Mar. 26, 2015

(65) Prior Publication Data

US 2016/0278506 A1 Sep. 29, 2016

(51) Int. Cl.

| | |
|---|---|
| ***A45F 3/04*** | (2006.01) |
| ***A63B 60/58*** | (2015.01) |
| ***A45C 13/10*** | (2006.01) |
| ***A45F 3/02*** | (2006.01) |
| *A45F 3/00* | (2006.01) |

(52) U.S. Cl.

CPC ..... *A45F 3/04* (2013.01); *A45C 13/103* (2013.01); *A45F 3/005* (2013.01); *A45F 3/02* (2013.01); *A45C 2013/1015* (2013.01); *A45F 2003/002* (2013.01); *A63B 60/58* (2015.10)

(58) Field of Classification Search

CPC ..... A45F 3/04; A63B 60/58
USPC ..... 224/627–659; D3/243; 190/102
See application file for complete search history.

(56) References Cited

U.S. PATENT DOCUMENTS 2,011,879 A * 8/1935 Stein ..... A45C 13/02 190/109
2,053,630 A * 9/1936 Plotkin ..... A45C 3/02 190/115
4,265,286 A * 5/1981 Rapoport ..... A45C 3/02 190/108
4,793,508 A 12/1988 Thompson
5,431,265 A * 7/1995 Yoo ..... A45C 3/00 190/103

(Continued)

FOREIGN PATENT DOCUMENTS

| | | |
|---|---|---|
| EP | 2233254 A1 | 9/2010 |
| GB | 2196242 A | 4/1988 |

(Continued)

OTHER PUBLICATIONS

International Search Report and Written Opinion dated Jun. 29, 2016 for PCT Patent Application No. PCT/US2016/023354, 14 pages.

*Primary Examiner* — Justin Larson
(74) *Attorney, Agent, or Firm* — Shook, Hardy & Bacon L.L.P.

(57) ABSTRACT

A bag, such as a backpack, is provided having first and second closure mechanisms. The backpack includes an opening at the top end of the bag, with the first and the second closure mechanisms configured to selectively secure and close the opening. The first closure mechanism is configured to couple a front side and a back side of the backpack at the top end to partially close the opening and form a first slot and a second slot. The second closure mechanism is configured to partially or completely secure the opening by securing a first edge of the opening to a second edge of the opening to close each slot. The second closure mechanism includes a first and a second releasable fastener which may be zippers. The first and second slots are alignable with one or more interior sections to form first and second equipment storage compartments within the backpack.

19 Claims, 6 Drawing Sheets

(56) References Cited

U.S. PATENT DOCUMENTS 5,447,261 A * 9/1995 Mitomi ..... A45F 3/04 190/110
5,676,286 A * 10/1997 Song ..... A45F 3/04 190/18 A
D387,198 S * 12/1997 Lehmann ..... 224/153
5,984,154 A * 11/1999 Scicluna ..... A45F 3/04 190/18 A
D448,160 S * 9/2001 Sijmons ..... D3/216
6,367,674 B1 * 4/2002 Tabor ..... A45F 3/04 224/153
6,375,057 B1 * 4/2002 Gorchian ..... A45F 5/02 150/114
D460,614 S * 7/2002 Reimers ..... D3/216
6,474,524 B1 * 11/2002 Ivarson ..... A45F 3/04 224/637
6,530,507 B2 * 3/2003 Oh ..... A45C 5/14 190/18 A
6,561,395 B2 * 5/2003 Lim ..... A45C 5/14 190/103
6,595,334 B1 * 7/2003 Saetia ..... A45C 5/143 190/102
6,742,684 B2 * 6/2004 Oh ..... A45C 9/00 224/153
7,036,641 B2 * 5/2006 Russo ..... A45C 5/143 190/115
7,111,731 B2 * 9/2006 Pratt ..... A45C 5/06 150/117
7,232,018 B1 * 6/2007 Salander ..... A45C 5/14 190/103
7,311,200 B2 * 12/2007 Godshaw ..... A45C 7/0036 206/373
7,395,930 B2 * 7/2008 Tauchen ..... A45C 3/00 190/109
7,451,861 B2 * 11/2008 Bhavnani ..... A45C 7/0077 150/113
7,575,117 B2 * 8/2009 Redzisz ..... A45C 7/0036 206/373
7,597,341 B2 * 10/2009 Russo ..... A45C 5/143 190/18 A
7,604,102 B2 * 10/2009 Albritton ..... A45C 3/00 190/107
7,628,188 B2 * 12/2009 Pratt ..... A45C 5/06 150/117
7,886,949 B2 * 2/2011 Fenton ..... A45C 7/0063 224/645
D650,576 S * 12/2011 Bertken ..... D3/217
8,123,090 B2 * 2/2012 Missick ..... A45F 4/02 224/153
D661,085 S * 6/2012 Custer ..... D3/217
D690,502 S * 10/2013 Bergquist ..... D3/216
8,678,259 B2 * 3/2014 Hurst ..... A45F 5/00 224/661
8,814,429 B2 * 8/2014 Roether ..... A43B 23/024 383/117
8,820,596 B1 * 9/2014 Bergquist ..... 224/153
9,131,749 B2 * 9/2015 Roether ..... A43B 23/024
9,210,976 B2 * 12/2015 Maeda ..... A45C 11/00
D748,918 S * 2/2016 Majeau ..... D3/216
2003/0164321 A1 9/2003 Ukitsu et al.
2004/0195791 A1 * 10/2004 Brookes-Inglis ..... A45C 5/14 280/47.26
2009/0206118 A1 8/2009 Sabbah

FOREIGN PATENT DOCUMENTS

WO 02102185 A1 12/2002
WO 2008013781 A2 1/2008

* cited by examiner

BACKPACK WITH CLOSURE MECHANISMS

TECHNICAL FIELD

The field of the invention relates to a bag, such as a backpack.

BRIEF SUMMARY

In brief, at a high level, this disclosure describes, among other things, a bag having an opening with one or more closure mechanisms. The bag includes one or more interior sections aligned in various ways with the opening to provide one or more storage compartments in the backpack.

In a first aspect of the invention, a backpack is provided. The backpack comprises a main compartment having a set of walls that define a storage space. The main compartment has a top end, a bottom end, a first side, a second side, a front side, and a back side. The top end includes an opening providing access to the storage space. The storage space generally includes a width between the first side and the second side, a depth between the top end and the bottom end, and a length between the front side and the back side. A first closure mechanism is coupled near the top end of the backpack. The first closure mechanism is configured to join the front side to the back side to divide the opening into a first slot and a second slot. A divider is positioned in the storage space and between the front side and the back side, the divider separating at least a portion of the main compartment into a first interior section and a second interior section. The first slot and the first interior section are alignable to form a first equipment-storage compartment, and the second slot and the second interior section are alignable to form a second equipment-storage compartment. One or more shoulder straps are coupled to the main compartment.

In a second aspect of the invention, another backpack is provided. The backpack comprises a main compartment having a set of walls that define a storage space. The main compartment has a top end, a bottom end, a first side, a second side, a front side, and a back side. The top end includes an opening that provides access to the storage space. The storage space generally includes a width between the first side and the second side, a depth between the top end and the bottom end, and a length between the front side and the back side. A first closure mechanism is coupled near the top end and is configured to selectively couple the front side to the back side to divide the opening into a first slot and a second slot. The first slot provides an access opening into the main compartment oriented toward the first side, and the second slot provides an access opening into the main compartment oriented toward the second side. A divider is positioned in the storage space and between the front side and the back side, the divider separating at least a portion of the main compartment into a first interior section and a second interior section. The first slot provides a first opening to the first interior section and the second slot provides a second opening to the second interior section. The first slot and the first interior section are alignable to form a first storage compartment and the second slot and the second interior section are alignable to form a second storage compartment. A second closure mechanism is coupled near the top end and configured to join the front side and the back side of the main compartment. The second closure mechanism may at least partially close the first and second slots. One or more shoulder straps are coupled to the main compartment.

In a third aspect of the invention, another backpack is provided. The backpack comprises a main compartment having a set of walls that define a storage space, the main compartment having a top end, a bottom end, a first side, a second side, a front side, and a back side. The top end includes an opening defined at least in part by a first top edge and a second top edge, the opening providing access to the storage space. The storage space generally includes a width between the first side and the second side, a depth between the top end and the bottom end, and a length between the front side and the back side.

A dividing panel is positioned in the storage space and between the front side and the back side, the dividing panel dividing at least a portion of the main compartment into a first interior section and a second interior section. The first and second interior sections extend substantially between the first side and the second side. The first and second interior sections also extend from the bottom end of the main compartment approximately half the depth.

A first closure mechanism is affixed to the top end at an approximate midpoint between the first side and the second side, the first closure mechanism configured to selectively couple a portion of the first top edge to a portion of the second top edge to divide the opening into a first slot and a second slot. Each slot is approximately equal in size. The first closure mechanism comprises a hook-and-loop strap having a first end, a second end, and an elongated portion therebetween, the first end affixed proximate the first or the second top edge, the second end having a first mating hook-and-loop component that couples to a corresponding second mating hook-and-loop component affixed to the opposite top edge.

A second closure mechanism is coupled near the top end and is configured to join a first top edge of the opening to a second top edge of the opening. The second closure mechanism includes a first releasable fastener which fastens the first top edge to the second top edge along a first-side portion corresponding to the first slot, and a second releasable fastener, which fastens the first top edge to the second top edge along a second-side portion corresponding to the second slot. The first and second releasable fasteners are configured to close the opening when brought together. First and second shoulder straps are each coupled to the main compartment of the backpack.

This summary is intended to provide a high-level overview of various aspects of the invention and to introduce a selection of concepts that are further described below in the detailed description. This summary is not intended to identify key or essential features of the claimed subject matter, nor is it intended to be used as an aid in isolation to determine the scope of the claimed subject matter. The scope of the invention is defined by the claims.

BRIEF DESCRIPTION OF THE DRAWINGS

The present invention is described in detail herein with reference to the attached drawing figures, which are incorporated herein by reference. In reference to the figures.

DETAILED DESCRIPTION

Figure 2A:
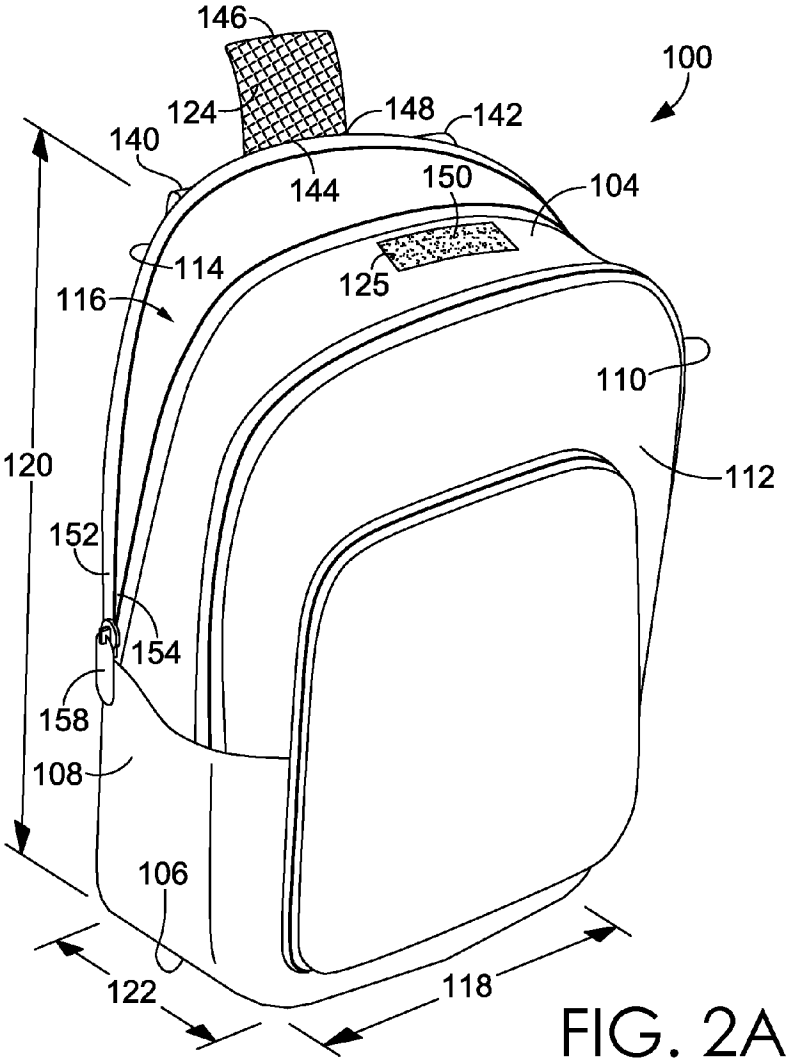
FIG. 2A depicts the backpack of FIG. 1 in a first open configuration, in accordance with an aspect hereof.

The subject matter of various aspects of the present invention is described with specificity herein to meet statutory requirements. The description itself is not intended to limit the scope of the claims. Rather, the claimed subject matter might be embodied or carried out in other ways to include different elements, combinations, components, or steps, including those similar to the ones described in this document, and in conjunction with other present or future technologies.

A first aspect provides for a backpack that includes a main storage compartment that is accessible through an opening near the top of the backpack. The main compartment includes a set of walls that define a storage space inside the backpack. The main compartment generally includes a top end, a bottom end, a first side, a second side, a front side, and a back side, which together form the storage space. Further, there is generally a width between the first side and the second side, a depth between the top end and the bottom end, and a length between the front side and the back side. The backpack may feature one or more shoulder straps coupled to the backpack to allow a wearer to easily carry the backpack, forming a traditional configuration.

The backpack includes a first closure mechanism coupled near the top end of the backpack. When secured, the first closure mechanism is configured to partially close the opening and divide the opening into a first slot and a second slot, each slot providing a respective first and second opening. In this regard, the first slot may provide an access opening into the main compartment oriented toward the first side of the main compartment, and the second slot may provide an access opening into the main compartment oriented toward the second side of the main compartment. The first and second slots, and corresponding openings, can be varied based on the size and structure of the first closure mechanism, and form different access openings for the one or more storage compartments within the backpack.

The backpack may further include a second closure mechanism. The second closure mechanism may have a first releasable fastener and a second releasable fastener, which may be zippers. In one configuration, the first releasable fastener may fasten a first top edge of the opening to a second top edge of the opening along a first-side portion of the opening oriented towards the first side, and the second releasable fastener may fasten the first top edge of the main compartment to the second top edge of the main compartment along a second-side portion of the opening oriented towards the second side. In this regard, the second closure mechanism may be configured to move between a first state and a second state, each state providing different arrangements of the opening. In the first state, the first releasable fastener and the second releasable fastener are positioned apart on the opening such that the first and second releasable fasters and the first closure mechanisms form the first slot and the second slot, respectively. In other words, the second closure mechanism is not fully secured to close the openings. In the second state, the first releasable fastener and second releasable fastener are brought together to substantially close the opening, such that there are no slots. The first and second releasable fasteners may operate independently to close the opening, allowing varying slot sizes on each side of the opening. When the first and second releasable fasteners are brought together to close the opening, the fasteners may be proximate to the first closure mechanism. In other words, the first and second releasable fasteners may meet in the middle of the opening, and may be partially or wholly covered by the first closure mechanism.

By way of example, the first releasable fastener may fasten the first top edge to the second top edge along a first side portion of the opening from about a first approximate midpoint between the top end and the bottom end on the first side to at least about the first closure mechanism, and the second releasable fastener may fasten the first top edge to the second top edge along a second side portion of the opening from about a second approximate midpoint between the top end and the bottom end on the second side to at least about the first closure mechanism. The first and second releasable fasteners may include first and second respective zippers, which may be anchored at respective first and second ends of the opening.

The main compartment may also include a divider positioned in the storage space and between the front side and the back side of the main compartment. The divider may be configured to separate at least a portion of the main compartment into a first interior section and a second interior section. In such a configuration, the first slot and the first or second interior section may be aligned to form a first storage compartment, and the second slot and the other of the first or the second interior section may be aligned to form a second equipment storage compartment. In this regard, the first storage compartment may form one portion of the main compartment accessible by at least the first slot, and the second storage compartment may form another portion of the main compartment accessible at least by the second slot.

Returning to the first closure mechanism, the first closure mechanism may incorporate a number of different components and configurations, allowing different interaction between the opening of the backpack, the first closure mechanism, and the second closure mechanism. For example, the first closure mechanism may have an elongated member with a first end fixedly attached to one of the front side or the back side of the main compartment. The elongated member second end may be configured to releasably attach to the other of the front side or the back side to secure the front side and the back side together, at least partially closing the opening at the top of the main compartment. When closed, the elongated member portion of the first closure mechanism may cover at least a portion of the first and second releasable fasteners when the first and second releasable fasteners are brought together.

Regarding the type of connection component used in the first closure mechanism, any number of components may be used to releasably attach the front side and the back side of the main compartment, or the first and the second top edges of the opening. The first closure mechanism may utilize velcro, a male/female connector, a hook-and-loop fastener, buttons, snaps, hooks, ties, or other similar components. The elongated portion of the first closure mechanism may be variety of shapes, widths, or lengths, depending on the structure of the opening and the structure of the top end of the bag, as well as the desired size of the first and second slots when the first closure mechanism is secured. In this regard, numerous arrangements are possible for the first and second closure mechanisms at the top end of the main compartment.

Figure 6:
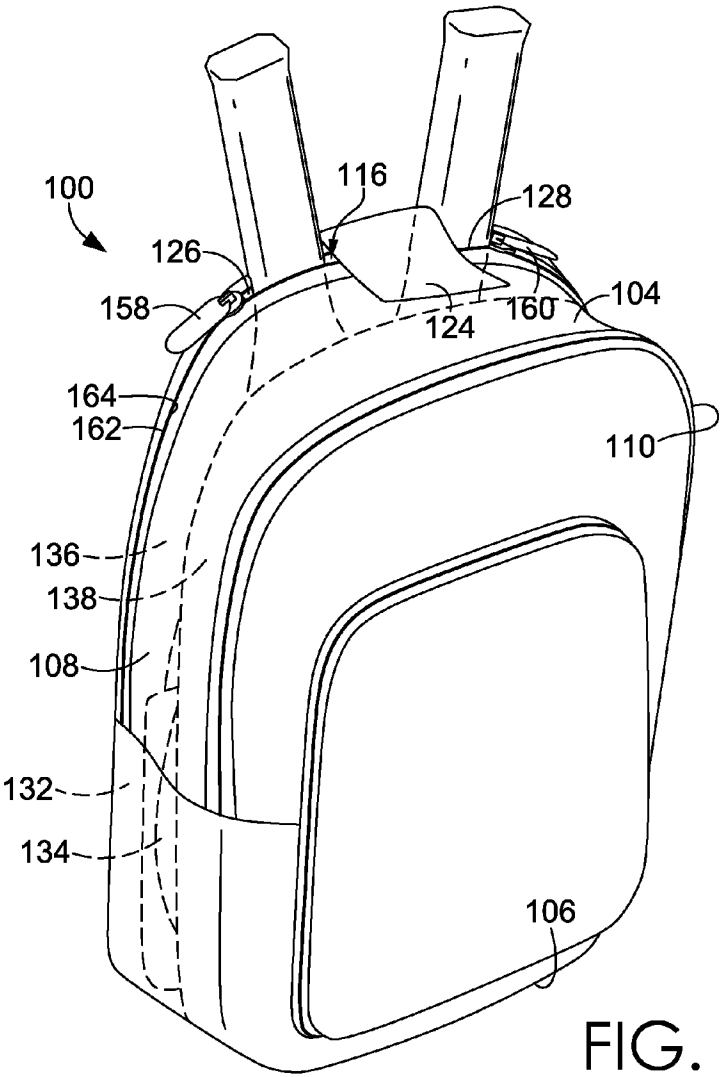
FIG. 6 depicts the backpack of FIG. 1 with items stowed in first and second storage compartments, in accordance with an aspect hereof.

When equipment is stored in the storage space, the slots and corresponding interior sections may be adjusted using the first and second closure mechanisms to allow securement of equipment in different orientations or positions. Each slot and corresponding opening may remain open, closed, or partially closed to adapt to the storage requirements of a particular object. For example, an elongated object that otherwise will not fit completely in the backpack, such as a tennis racket, may be stored in the first or second storage compartment by placing part of the object in the first or the second interior section, allowing an elongated or extending portion of the object to extend from the respective first or second slot. The first closure mechanism may be secured and the second closure mechanism may be partially secured to assist in bracing or holding the extended, extruded portion of the equipment in place near the opening of the backpack. In other words, the extended portion may be secured using both the first closure mechanism and the second closure mechanism and an interior section of the backpack. An example of this configuration is depicted in FIG. 6.

Additional closure mechanisms may be incorporated into the top end of the main compartment to provide additional arrangements. For example, a third closure mechanism similar to the first closure mechanism may be incorporated into the top end of the main compartment near the opening of the backpack. The first and third closure mechanisms may be arranged such that when they are secured, they form three independent slots with three corresponding openings, each opening providing access to one or more interior sections of the backpack. The slots and interior sections may be aligned or oriented to form varying equipment storage compartments, similar to those described above. The second closure mechanism may be configured to close the first and second slots, and subsequently the third slot, if desired. The first closure mechanism, the second closure mechanism, third closure mechanism, and the slots may be used adjustably secure stored equipment that is extruded from the backpack as described above and similar to the example shown in FIG. 6.

The divider may be configured in any number of ways to provide various interior sections and storage compartments. For example, the divider may include a first dividing panel positioned in the storage space and between the front side and the back side, the first dividing panel separating at least a portion of the main compartment into a first interior section and a second interior section. The first dividing panel may have a first-panel rearward surface facing toward the back side of the main compartment, and a first-panel forward surface facing toward the front side of the main compartment. The dividing panel may include first and second edges coupled to respective first and second locations on the back side of the main compartment. In this arrangement, the first interior section is at least partially between the first-panel rearward facing surface and the back-side of the main compartment, and the second interior section is at least partially between the first-panel forward facing surface and the front side of the main compartment, forming at least part of the first and second equipment storage compartments.

The divider may further comprise first and second dividing panels. The first interior section extends between the first-panel rearward surface and the back-side of the main compartment. The second dividing panel may have a second-panel rearward surface and a second-panel forward surface, the second dividing panel being coupled between the first panel forward surface and the front side, such that the second-panel rearward surfaces faces towards the first-panel forward surface and the second interior section extends at least partially between the second-panel rearward surface and the first panel forward surface. The first dividing panel and the second dividing panel may each include first and second edges, which may be coupled to a respective first divider side panel and a second divider side panel. The first and second divider side panels may extend generally perpendicular to the first dividing panel and the second dividing panel, and may be coupled to the back side of the main compartment at first and second locations, respectively. The divider side panels may be used to form distinct, rectangular shaped interior sections in the main compartment that form a part of the storage compartments.

The first and second dividing panels may extend across substantially the entire width of the main compartment storage space. The dividing panels may also extend from the bottom end of the main compartment to a position at least half of the depth of the main compartment. The dividing panels, side walls, and overall storage spaces may include various forms of padding to protect equipment storage in the backpack, based on the needs of the user and the desired equipment to be stored. The panels themselves may be padded as well to protect specific equipment, such as a tennis racket.

Figure 1:
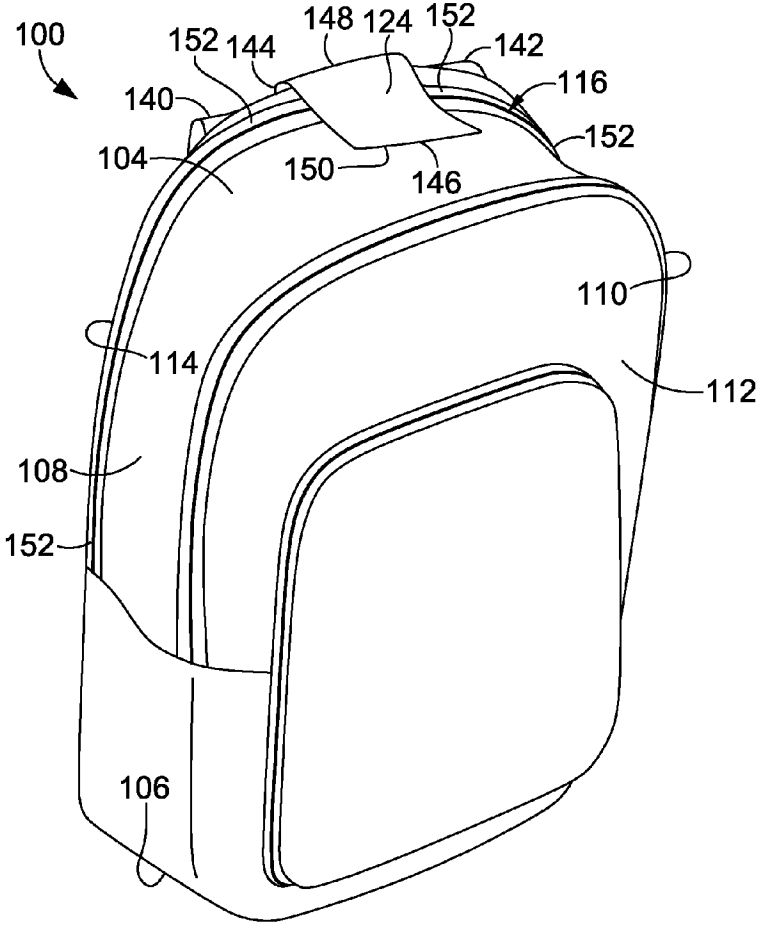
FIG. 1 depicts a backpack having first and second closure mechanisms, in accordance with an aspect hereof.

Referring now to FIG. 1, a backpack is depicted, in accordance with an aspect hereof. Generally, the backpack 100 includes a top end 104, a bottom end 106, a first side 108, a second side 110, a front side 112, and a back side 114. A first and a second shoulder strap 140, 142 are shown coupled to the back side 114 of the backpack 100. In FIG. 1, the top end 104 includes an opening 116 which is depicted in a closed configuration, secured by a first closure mechanism 124 and a second closure mechanism 152. The first closure mechanism 124 is integrated into the top end 104 of the backpack 100, and includes a first end 144 and a second end 146. The first end 144 is affixed to the top end 104 of the backpack 100 at first location 148, oriented toward the back side 114 of the backpack 100, and the second end 146 is configured such that it can be selectively secured to the top end 104 of the backpack 100 at a second location 150 oriented towards the front side 112 of the backpack 100 on the opposite side of the opening 116. In FIG. 1, the first closure mechanism 124 is secured to partially close the opening 116, and the second closure mechanism 152 is secured to close the remaining portion of the opening 116.

Referring now to FIG. 2A, the backpack of FIG. 1 is depicted in a first open configuration, in accordance with an aspect hereof. In FIG. 2A, the backpack 100 again includes the top end 104, the bottom end 106, the first side 108, the second side 110, the front side 112, the back side 114, and the first and second shoulder straps 140, 142. The backpack 100 also includes a width 118 between the first side 108 and the second side 110, a depth 120 between the top end 104 and the bottom end 106, and a length 122 between the front side 112 and the backside 114. The first closure mechanism 124 and the second closure mechanism 152 are both unsecured, allowing a fully open configuration of the opening 116. Regarding the first closure mechanism 124, the first end 144 is affixed to the top end 104 at the first location 148, and the second end 146 of the first closure mechanism 124 is unattached to the top end 104 of the backpack 100 at the corresponding second location 150. The second location 150 includes a mating surface 125 forming part of the first closure mechanism 124. In FIG. 2A, the second closure mechanism 152 includes a first releasable fastener 158 and a second releasable fastener 160 (not shown), the first releasable fastener 158 positioned at a first end 154 of the opening 116 and the second releasable fastener 160 positioned at a second end 156 (not shown) of the opening 116. The first and second releasable fasteners 158, 160 are positioned maximally apart in FIG. 2A to allow a fully open configuration of the opening 116. To close the opening 116, the first releasable fastener 158 and second releasable fastener 160 can be moved toward each other until they are coupled together to close the opening 116 of the backpack 100.

Figure 2C:
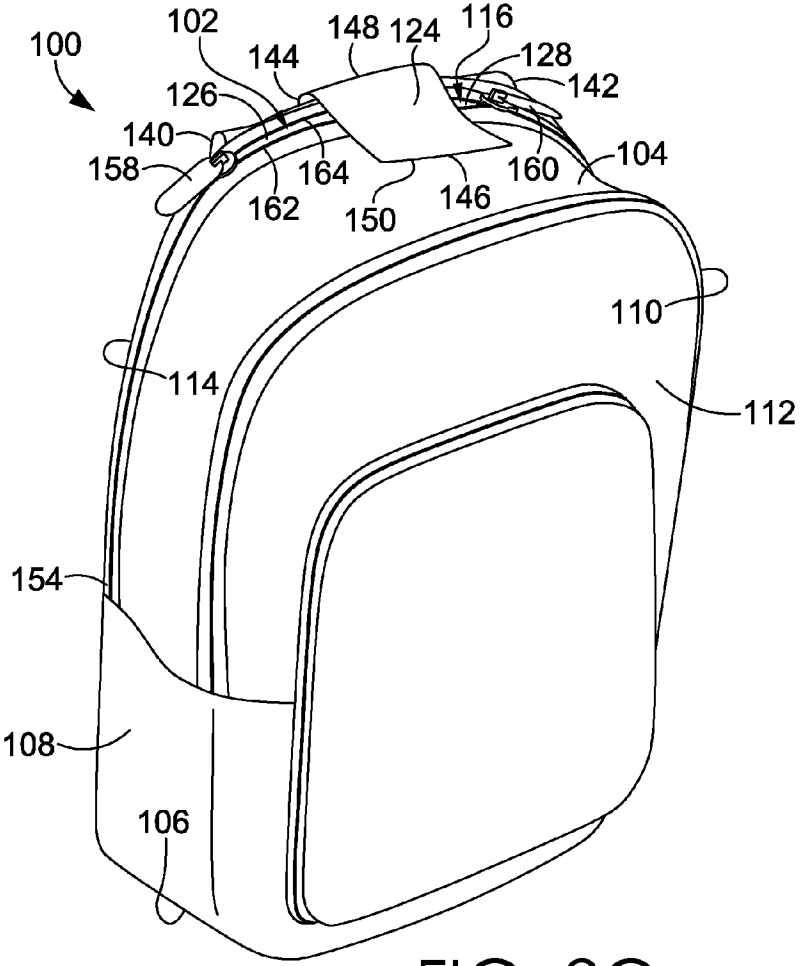
FIG. 2C depicts the backpack of FIG. 1 in a second closed configuration with the first closure mechanism secured and the second closure mechanism partially secured, in accordance with an aspect hereof.
Figure 2B:
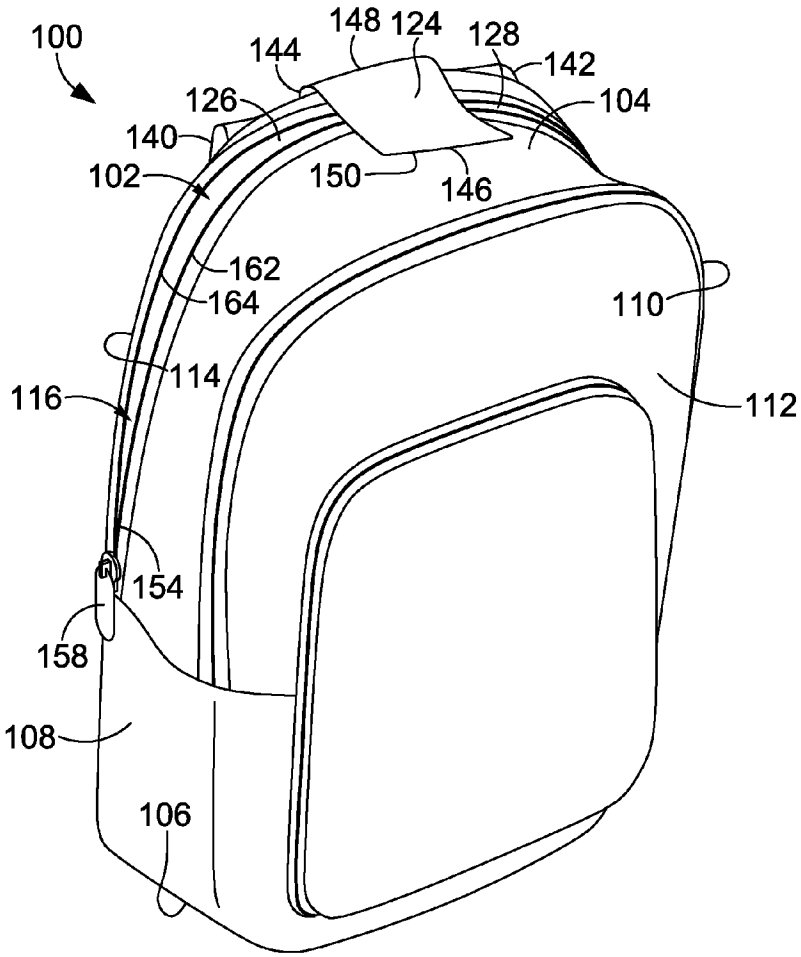
FIG. 2B depicts the backpack of FIG. 1 in a first closed configuration with the first closure mechanism secured and the second closure mechanism unsecured, in accordance with an aspect hereof.

Referring now to FIG. 2B, the backpack of FIG. 1 is depicted in a first closed configuration with a first closure mechanism secured, in accordance with an aspect hereof. In FIG. 2B, the backpack 100 shows the first closure mechanism 124 with the first end 144 affixed to the top end 104 at the first location 148 and the second end 146 selectively secured to the top end 104 at the second location 150. The first closure mechanism 124 is shown in a closed configuration securing the opening 116 and forming a first slot 126 and a second slot 128, each of which provides an opening, or access, into the storage space 102. The first slot 126 is oriented toward the first side 108 of the backpack 100, and the second slot 128 is oriented toward the second side 110 of the backpack 100. The first slot is configured to provide access to, and be aligned with, the first interior section 132 of the backpack 100 and the second slot 128 is configured to provide access to, and be aligned with, the second interior section 134 of the backpack 100 (See FIGS. 3 and 4 for exemplary illustrations of the interior sections).

Referring to FIG. 2C, the backpack of FIG. 1 is depicted in a second closed configuration with the first closure mechanism secured and the second closure mechanism partially secured, in accordance with an aspect hereof. In FIG. 2C, the first closure mechanism 124 is secured to close the opening 116 and provide the first slot 126 and the second slot 128, each of which provides an opening, or access, into the storage space 102. The first slot 126 is alignable with the first interior section 132 to form the first equipment storage compartment 136 and the second slot 128 is alignable with the second interior section 134 to form the second equipment storage compartment 138 (see FIGS. 3 and 4 for additional views of the interior sections 132, 134). Additionally, the opening 116 is partially closed by the second closure mechanism 152, which includes a first releasable fastener 158 and a second releasable fastener 160, each of which is configured to couple and secure the first edge 162 of the opening 116 to the second edge 164 of the opening 116 starting at opposite ends 154, 156 (not shown) and along different portions of the opening 116. In FIG. 2C, each releasable fastener 158, 160 is moved toward the other to partially closed opening 116. The releasable fasteners 158, 160 can be further moved toward each other to completely close the opening 116 (See FIG. 2D). The first slot 126 is configured to secure an object stored in the first interior section 132 and extending through the first slot 126, and the second slot 128 is configured to secure an object stored in the second interior section 134 and extending through the second slot 128. Therefore, the first slot 126 and first interior section 132 and the second slot 128 and second interior section 134 are alignable, respectively, to form the first and second respective equipment storage compartments 136, 138 (See FIG. 6 for a further illustration of the storage compartments).

Figure 2E:
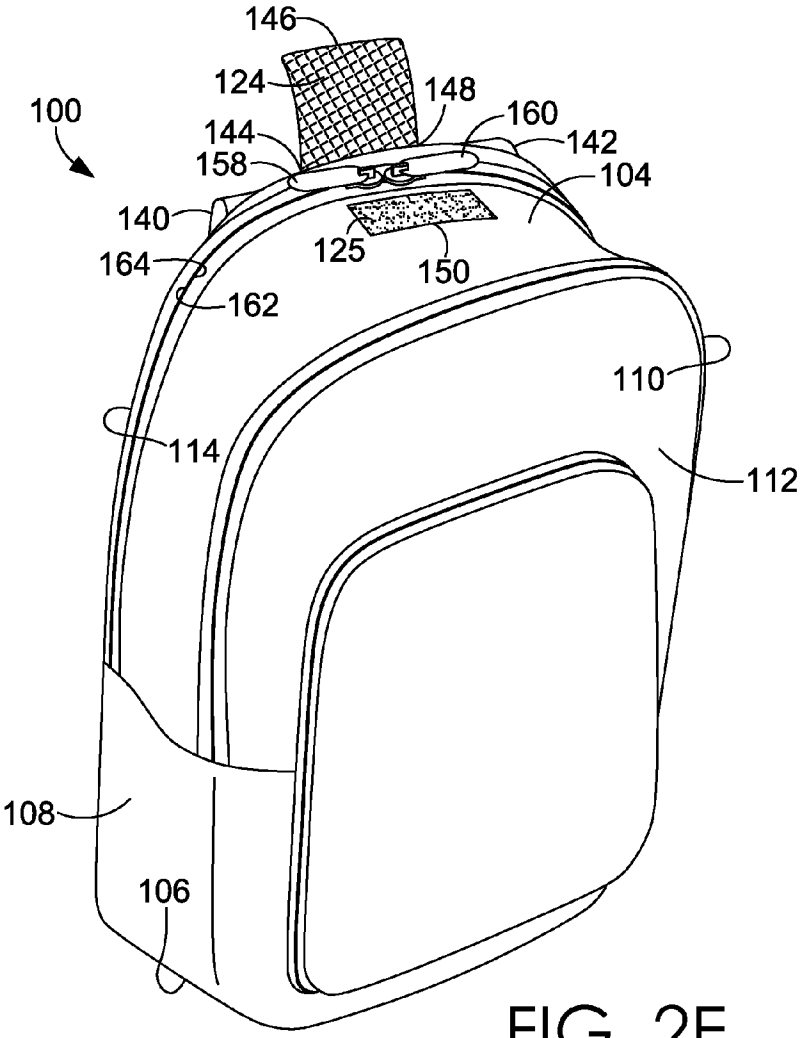
FIG. 2E depicts the backpack of FIG. 1 in a fourth closed configuration with the first closure mechanism unsecured and the second closure mechanism secured, in accordance with an aspect hereof.
Figure 2D:
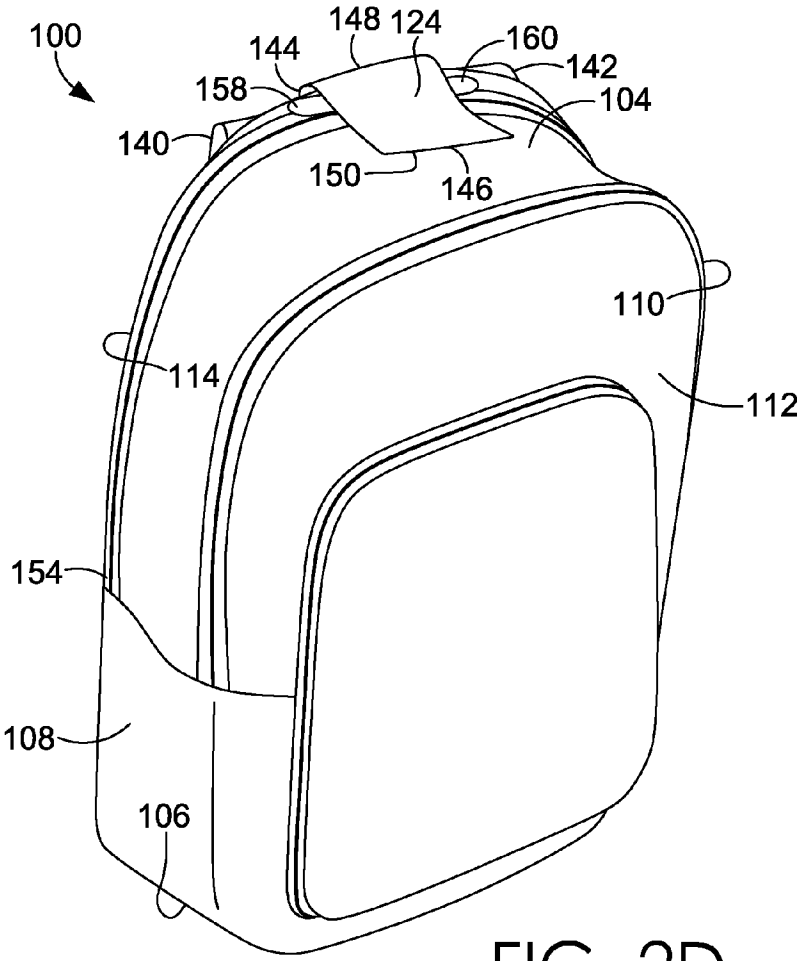
FIG. 2D depicts the backpack of FIG. 1 in a third closed configuration with the first closure mechanism secured and the second closure mechanism secured, in accordance with an aspect hereof.

Referring to FIG. 2D, the backpack of FIG. 1 is depicted in a third closed configuration with both the first closure mechanism and the second closure mechanism fully secured, in accordance with an aspect hereof. In FIG. 2D, the first releasable fastener 158 and the second releasable fastener 160 of the second closure mechanism 152 are brought together to close the slots 126, 128, and subsequently close the opening 116. The first closure mechanism 124 is also secured to assist in closing the opening 116 of the backpack 100. Accordingly, the first closure mechanism 124 and the second closure mechanism 152 work together to fully secure the opening 116.

Referring to FIG. 2E, the backpack of FIG. 1 is depicted with the first closure mechanism unsecured and the second closure mechanism fully secured, in accordance with an aspect hereof. In FIG. 2E, the second end 146 of the first closure mechanism 124 is unattached to the second location 150 of the top end 104. The second closure mechanism 152 is fully secured, with the first releasable fastener 158 and the second releasable fastener 160 brought together to close the opening 116.

Figure 3:
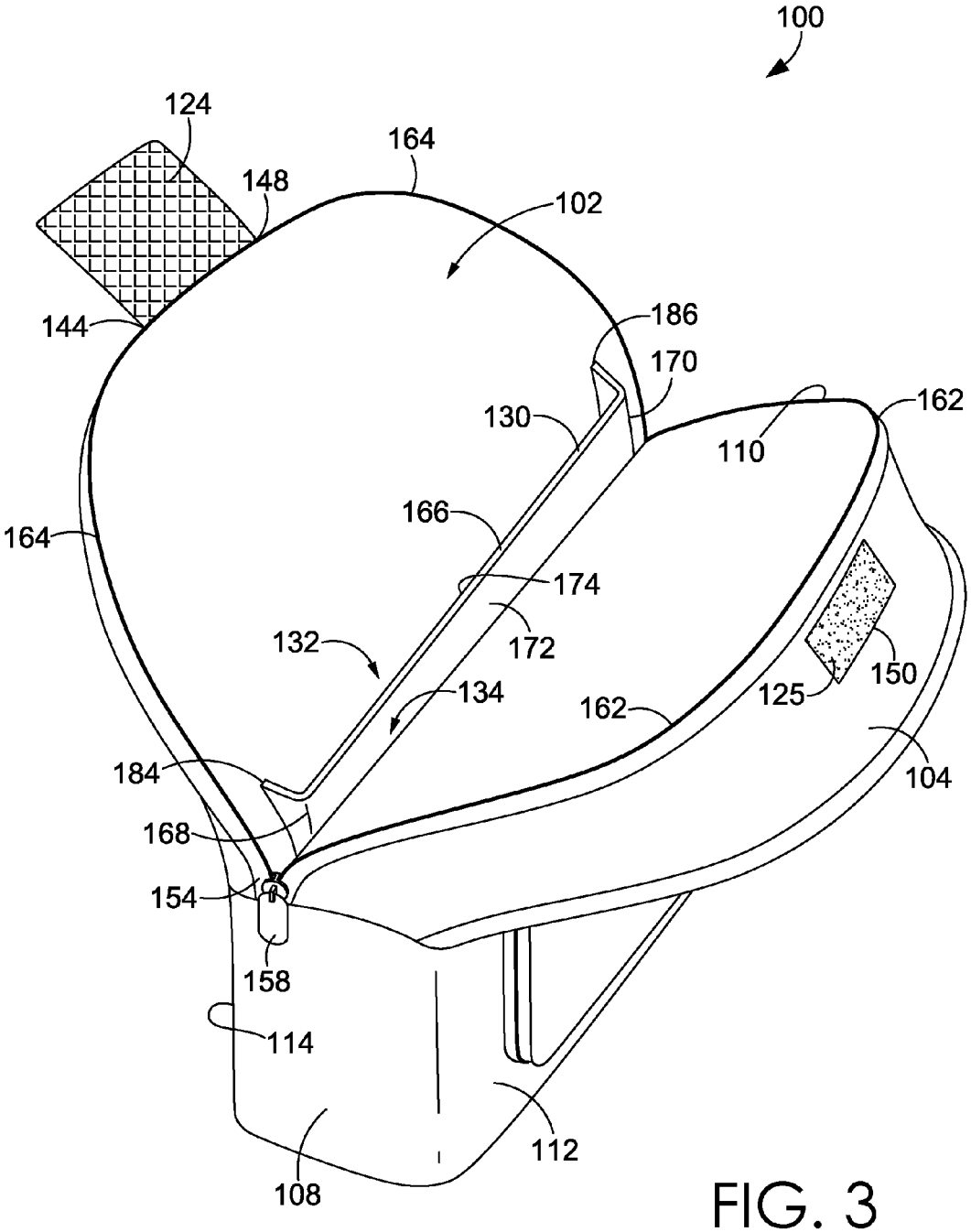
FIG. 3 depicts the backpack of FIG. 1 in an open configuration with a divider incorporated into the main compartment of the backpack, in accordance with an aspect hereof.

Referring to FIG. 3, the backpack of FIG. 1 is depicted in an open configuration with a first divider incorporated into a main compartment of the backpack, in accordance with an aspect hereof. In FIG. 3, the backpack 100 is shown with the first top edge 162 and second top edge 164 unsecured and separated. In this regard, neither the first closure mechanism 124 or the second closure mechanism 152 are fastened. The divider 130 is incorporated into the storage space 102 and includes a first dividing panel 166 having a first edge 168, a second edge 170, a first-panel forward surface 172 and a first-panel rearward surface 174. The first-panel forward surface 172 faces toward to the front side 112 of the backpack 100 and the first panel rearward surface 174 faces toward the back side 114 of the backpack 100. The first edge 168 of the first dividing panel 166 is coupled to the backside 114 at a first location 184, and the second edge 170 of the first dividing panel 166 is coupled to the backside 114 at a second location 186. In FIG. 3, the first dividing panel 166 extends from approximately the first side 108 to the second side 110 across substantially the entire width 118 of the storage space 102 and also extends from the bottom end 106 of the main compartment approximately half of the depth 120.

The dividing panel 166 in FIG. 3 at least partially forms the first and second interior sections 132, 134 inside the storage space 102. The first interior section 132 is oriented approximately and at least partially between the first-panel rearward surface 174 and the back side 114 of the backpack 100 and the second interior section 134 is oriented approximately and at least partially between the first panel forward surface 172 and the front side 112 of the backpack 100. Additionally, the first and/or second interior sections 132, 134 may align with the respective first and second slots 126, 128 to form at least part of the respective first and second equipment storage compartments 136, 138 (See FIG. 6 for further illustrations of the equipment storage compartments).

Figure 4:
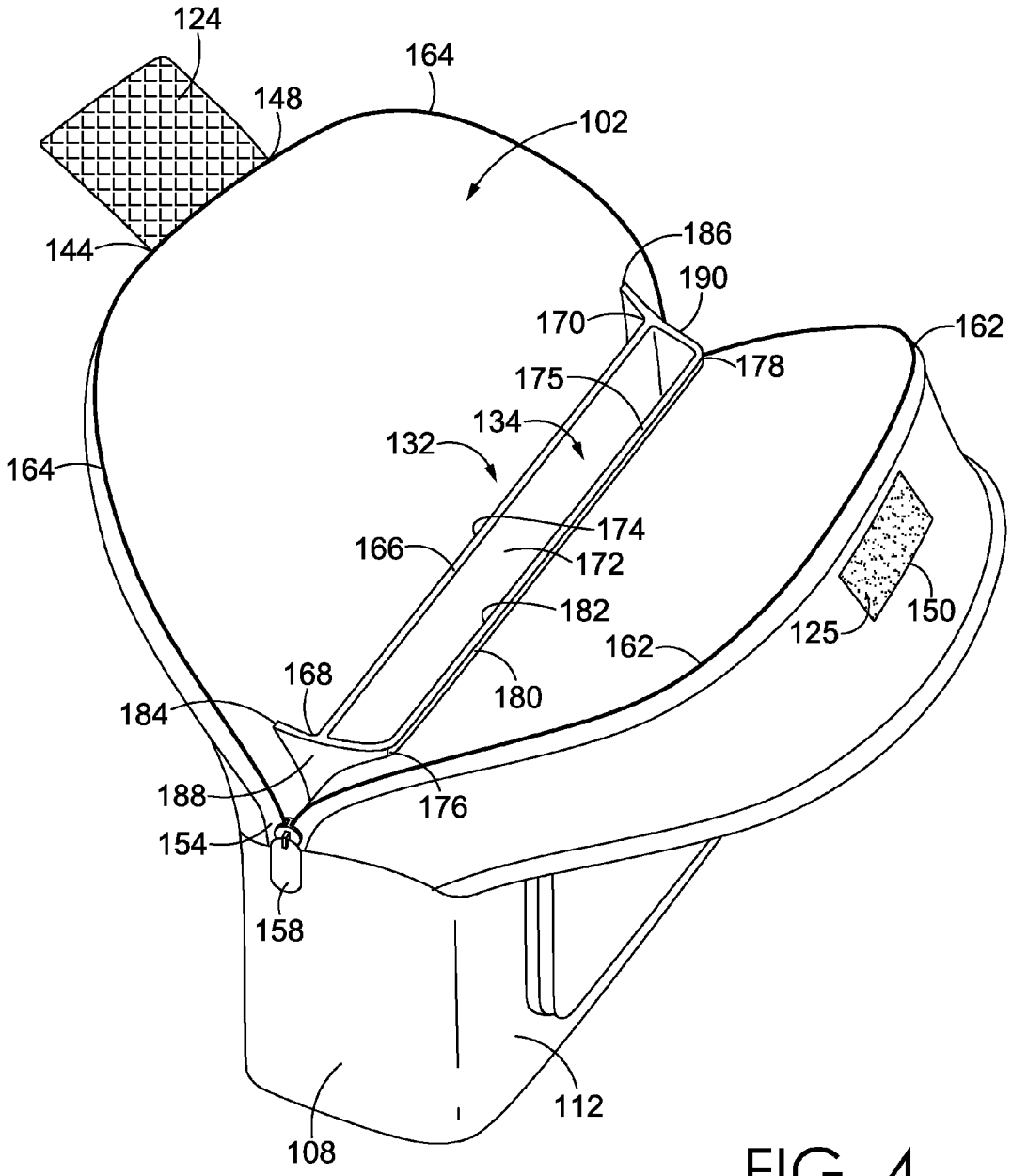
FIG. 4 depicts a backpack in an open configuration with a divider having a first dividing panel and a second dividing panel, in accordance with an aspect hereof.

Referring to FIG. 4, the backpack of FIG. 1 is depicted in an open configuration with a divider incorporated, the divider having a first dividing panel and a second dividing panel, in accordance with aspect hereof. In FIG. 3, the backpack 100 is depicted with the first top edge 162 and the second top edge 164 fully separated and unsecured such that the first closure mechanism 124 and the second closure mechanism 152 are unsecured, and the opening 116 is fully open. The divider 130 includes a first dividing panel 166 and a second dividing panel 175. The first and second dividing panels 166, 175 extend from approximately the first side 108 to the second side 110 of the backpack 100, or across substantially the entire width 118 of the backpack 100, and also extend from the bottom end 106 of the storage space 102 approximately half of the depth 120 of the backpack 100.

The second dividing panel includes a first edge 176, a second edge 178, a second-panel forward surface 180, and a second-panel rearward surface 182. The first and second dividing panels 166, 175 are coupled to a first side panel 188 and a second side panel 190, which extend generally perpendicular to the first dividing panel 166 and the second dividing panel 175. The first and second side panels 188, 190 are coupled to the back side 114 of the storage space 102 at the first location 184 and the second location 186, respectively. The first and second dividing panels 166, 175 and first and second side panels 188, 190 form at least part of the first interior section 132 and the second interior section 134 of the storage space 102 in the backpack 100. The first interior section 132 and second interior section 134 are configured to align with the first or second slots 126, 128 to form respective first and second equipment storage compartments 136, 138.

Figure 5:
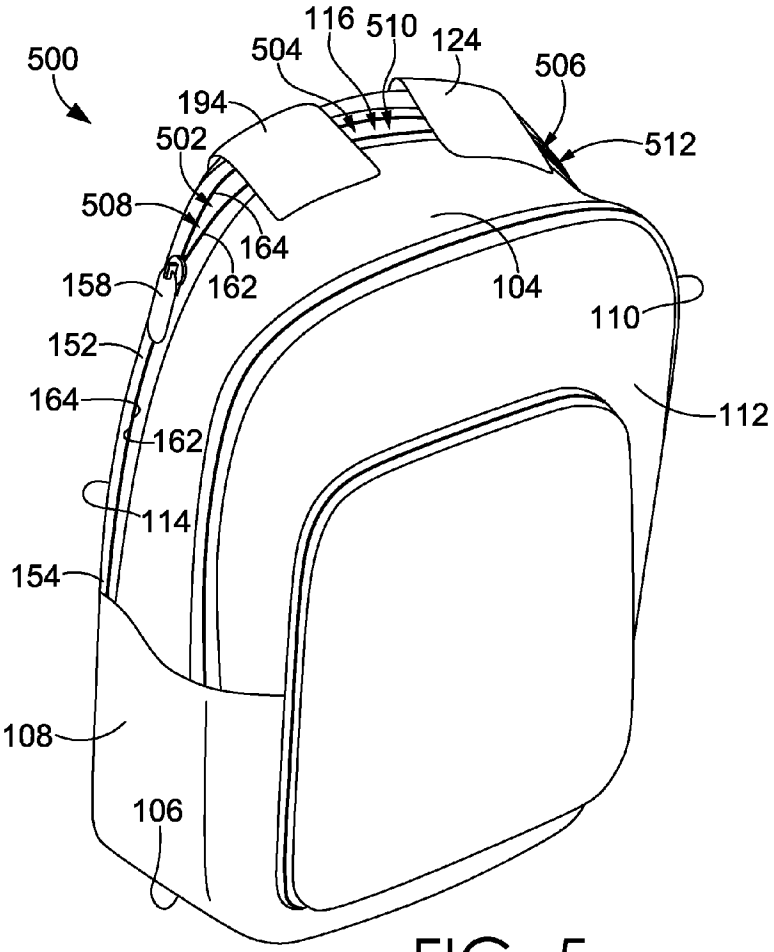
FIG. 5 depicts a backpack with first, second, and third closure mechanisms forming respective first, second, and third slots, in accordance with an aspect hereof.

Referring to FIG. 5, a backpack is depicted having first, second, and third closure mechanisms, in accordance with an aspect hereof. In FIG. 5, the backpack 500 includes a first closure mechanism 124 and a similarly designed third closure mechanism 194 which divide the opening 116 into first, second, and third slots 126, 128, 196 forming respective first, second, and third openings 502, 504, 506. The first, second, and third slots 126, 128, 196 are configured to each align with one or more interior storage sections, such as the first interior section 132 or second interior section 134, inside the storage space 102 of the backpack 100. In this regard, the first, second, and third slots 126, 128, 196 may form multiple individual storage compartments, such as the first storage compartment 136 or the second storage compartment 138.

Referring to FIG. 6, the backpack of FIG. 2C is depicted with equipment in the storage compartments, in accordance with aspect hereof. In FIG. 6, the backpack 100 of FIG. 2C is depicted with the first closure mechanism 124 secured and the second closure mechanism 152 partially secured, the second closure mechanism first and second releasable fasteners 158, 160 partially engaged to close the opening 116. Additionally, the backpack 100 includes two tennis rackets stored in the first and second equipment storage compartments 136, 138. The first equipment storage compartment 136 includes the first slot 126 aligned with the first interior section 132 and the second equipment storage compartment 138 includes the second slot 128 aligned with the second interior section 134. Additionally, the first releasable fastener 158 and the second releasable fastener 160 are partially moved toward the first closure mechanism 124, coupling the first side 162 to the second side 164 of the opening 116 to partially close the opening 116. In this regard, the first releasable fastener 158 and the second releasable fastener 160 brace, or secure, the first and the second racket handles against the first closure mechanism 124, with one racket stored in the first equipment storage compartment 136 and the other racket stored in the second equipment storage compartment 138.

From the foregoing, it will be seen that this invention is one well adapted to attain all the ends and objects herein set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope of the claims, it is to be understood that all matter herein set forth or shown in the accompanying drawings is to be interpreted as illustrative and non-limiting.

The invention claimed is:

1. A backpack comprising:

a main compartment having a set of walls that define a storage space, the main compartment having a top end and a bottom end, a first side and a second side, and a front side and a back side, wherein the top end includes an opening that provides access to the storage space, the opening comprising a first top edge and a second top edge that at least partially circumscribe the opening, and wherein the storage space includes a width between the first side and the second side, a depth between the top end and the bottom end, and a length between the front side and the back side;

a first closure mechanism coupled to the main compartment, the first closure mechanism comprising an elongated member having a first end secured to the back side and a second end that is releasably securable to the top end between the back side and the front side to bridge the opening into a first slot and a second slot located on opposite sides of the first closure mechanism;

a first zipper closure mechanism that releasably fastens the first top edge to the second top edge along a first-side portion of the opening;

a second zipper closure mechanism that releasably fastens the first top edge to the second top edge along a second-side portion of the opening, the first and second zipper closure mechanisms configured to close the opening by sliding towards and abutting one another along the first top edge and the second top edge;

a divider positioned in the storage space and between the front side and the back side, the divider separating at least a portion of the main compartment into a first interior section and a second interior section, the divider positioned such that the divider is enclosed within the storage space when the first and second zipper closure mechanisms are slid towards one another, wherein the first slot and the first interior section are alignable to form a first equipment-storage compartment and the second slot and the second interior section are alignable to form a second equipment-storage compartment; and one or more shoulder straps coupled to the back side of the main compartment.

2. The backpack of claim 1, wherein the backpack further includes an exterior pocket positioned proximate to the front side of the main compartment, and wherein, when the second end of the elongated member is releasably secured to the top end, an opening to the exterior pocket remains uncovered by the first closure mechanism.

3. The backpack of claim 2, wherein the second end includes a first part of a hook-and-loop fastening system.

4. The backpack of claim 2, wherein the second end includes a first part of a male/female connector system.

5. The backpack of claim 2, wherein the first end is fixedly attached near an approximate mid-point between the first side and the second side, such that the first slot and the second slot include respective sizes that are approximately equal.

6. The backpack of claim 1, wherein the divider includes a first dividing panel having a first-panel rearward surface and a first-panel forward surface, and wherein the first-panel rearward surface faces towards the back side of the main compartment and the first-panel forward surface faces towards the front side of the main compartment, the first interior section being at least partially between the first-panel rearward surface and the back side and the second interior section being at least partially between the first-panel forward surface and the front side.

7. The backpack of claim 6, wherein the divider includes a second dividing panel having a second-panel rearward surface and a second-panel forward surface, the second dividing panel being coupled between the first-panel forward surface and the front side, such that the second-panel rearward surface faces towards the first-panel forward surface and the second interior section extends at least partially between the second panel rearward surface and the first panel forward surface.

8. The backpack of claim 7, wherein the first dividing panel and the second dividing panel are coupled to a first divider side panel and a second divider side panel, which extend generally perpendicular to the first dividing panel and the second dividing panel and are connected to the back side of the main compartment.

9. The backpack of claim 8, wherein the first and second dividing panels include a respective padding element between respective rearward surfaces and respective forward surfaces and extend across substantially the width of the main compartment.

10. The backpack of claim 9, wherein the first and second dividing panels extend from the bottom end to a position at least half of the depth of the main compartment.

11. The backpack of claim 1, wherein, when the first closure mechanism is secured, a size of the first slot is adjustable by sliding the first zipper closure mechanism towards the first closure mechanism and a size of the second slot is adjustable by sliding the second zipper closure mechanism towards the first closure mechanism.

12. The backpack of claim 1, wherein the storage space includes a padding element.

13. The backpack of claim 1, wherein the divider further comprises first and second dividing panels.

14. A backpack comprising:

a main compartment having a set of walls that define a storage space, the main compartment having a top end and a bottom end, a first side and a second side, and a front side and a back side, wherein the top end includes an opening that provides access to the storage space, the opening comprising a first top edge and a second top edge that at least partially circumscribe the opening, and wherein the storage space includes a width between the first side and the second side, a depth between the top end and the bottom end, and a length between the front side and the back side;

a first closure mechanism coupled to the top end of the main compartment, the first closure mechanism comprising an elongated member having a first end secured to the back side and a second end that is releasably securable to the top end between the back side and the front side to bridge the opening into a first slot and a second slot located on opposite sides of the first closure mechanism, the first slot providing an access opening into the main compartment oriented toward the first side of the main compartment, the second slot providing an access opening into the main compartment oriented toward the second side of the main compartment;

a divider positioned in the storage space and between the front side and the back side, the divider separating at least a portion of the main compartment into a first interior section and a second interior section, the first slot providing a first opening to the first interior section and the second slot providing a second opening to the second interior section, wherein the first slot and the first interior section are alignable to form a first storage compartment and the second slot and the second interior section are alignable to form a second storage compartment;

a first zipper closure mechanism that releasably fastens the first top edge to the second top edge along a first-side portion of the opening;

a second zipper closure mechanism that releasably fastens the first top edge to the second top edge along a second-side portion of the opening, the first and second zipper closure mechanisms configured to close the opening by sliding towards and abutting one another along the first top edge and the second top edge, wherein the divider is positioned such that the divider is enclosed within the storage space when the first and second zipper closure mechanisms are slid towards one another; and one or more shoulder straps coupled to the back side of the main compartment.

15. The backpack of claim 14, wherein the backpack further includes an exterior pocket positioned proximate to the front side of the main compartment, and wherein, when the second end of the elongated member is releasably secured to the top end, an opening to the exterior pocket remains uncovered by the first closure mechanism.

16. The backpack of claim 14, wherein, when the first closure mechanism is releasably secured, the first and second zipper closure mechanisms may be slid towards and abut each other such that the first and second zipper closure mechanisms are at least partially concealed beneath the first closure mechanism.

17. The backpack of claim 16, wherein the first zipper closure mechanism and the second zipper closure mechanism are moveable between a separated position to create the first slot and the second slot, respectively, and an abutted position in which the opening is substantially closed.

18. A backpack comprising:

a main compartment having a set of walls that define a storage space, the main compartment having a top end and a bottom end, a first side and a second side, and a front side and a back side, wherein the top end includes an opening defined at least in part by a first top edge and a second top edge, the opening providing access to the storage space, and wherein the storage space includes a width between the first side and the second side, a depth between the top end and the bottom end, and a length between the front side and the back side;

a dividing panel positioned in the storage space and between the front side and the back side, the dividing panel dividing at least a portion of the main compartment into a first interior section and a second interior section, the first and second interior sections extending substantially between the first side and the second side;

a first closure mechanism affixed to the top end at an approximate midpoint between the first side and the second side, the first closure mechanism comprising an elongated member having a first end secured to the back side and a second end that is releasably securable to the top end between the back side and the front side to divide the opening into a first slot and a second slot each approximately equal in size, the elongated member comprising a hook-and-loop strap, wherein the second end of the elongated member includes a first mating hook-and-loop component that couples to a corresponding second mating hook-and-loop component affixed to the top end of the main compartment;

a first zipper closure mechanism that releasably fastens the first top edge to the second top edge along a first-side portion of the opening;

a second zipper closure mechanism that releasably fastens the first top edge to the second top edge along a second-side portion of the opening, the first and second zipper closure mechanisms configured to close the opening by sliding towards and abutting one another along the first top edge and the second top edge, wherein the dividing panel is positioned such that the dividing panel is enclosed within the storage space when the first and second zipper closure mechanisms are slid towards one another; and a first and a second shoulder strap each coupled to the back side of the main compartment.

19. The backpack of claim 18, further comprising at least one additional pocket positioned proximate to the front side of the main compartment, wherein, when the first mating hook-and-loop component and the second mating hook-and-loop component are secured to each other, an opening to the additional pocket remains uncovered by the first closure mechanism.

* * * * *